US007955772B2

(12) United States Patent
Schuster et al.

(10) Patent No.: US 7,955,772 B2
(45) Date of Patent: Jun. 7, 2011

(54) DRY TONER, PROCESSES FOR THE PRODUCTION THEREOF, AND THE USE THEREOF

(75) Inventors: Thomas Schuster, Lauf (DE); Hans-Jörg Kremitzl, Eckental (DE)

(73) Assignee: Eckart GmbH (DE)

( * ) Notice: Subject to any disclaimer, the term of this patent is extended or adjusted under 35 U.S.C. 154(b) by 605 days.

(21) Appl. No.: 11/719,902

(22) PCT Filed: Nov. 22, 2005

(86) PCT No.: PCT/EP2005/012487

§ 371 (c)(1), (2), (4) Date: Jul. 31, 2007

(87) PCT Pub. No.: WO2006/056402

PCT Pub. Date: Jun. 1, 2006

(65) Prior Publication Data

US 2008/0193868 A1 Aug. 14, 2008

(30) Foreign Application Priority Data

Nov. 22, 2004 (DE) ..... 10 2004 056 330

(51) Int. Cl.
*G03G 9/09* (2006.01)

(52) U.S. Cl. ..... 430/108.1; 430/108.4; 430/108.6; 430/108.7; 430/108.8; 430/108.24; 430/137.1; 430/137.15; 399/111; 399/381

(58) Field of Classification Search ..... 430/108.1, 430/108.24, 108.4, 108.6, 108.7, 108.8, 137.1, 430/137.15; 399/111, 381
See application file for complete search history.

(56) References Cited

U.S. PATENT DOCUMENTS

| | | | | |
|---|---|---|---|---|
| 4,071,670 | A * | 1/1978 | Vanzo et al. | 526/88 |
| 4,771,086 | A * | 9/1988 | Martin | 523/205 |
| 5,091,010 | A * | 2/1992 | Souma et al. | 106/403 |
| 5,166,027 | A * | 11/1992 | Machida et al. | 430/108.6 |
| 5,290,652 | A | 3/1994 | Harakawa et al. | 430/106.6 |
| 5,466,482 | A | 11/1995 | Johnson | 427/212 |
| 5,653,794 | A * | 8/1997 | Weber et al. | 106/442 |
| 5,837,049 | A | 11/1998 | Watson et al. | 106/427 |
| 5,856,378 | A | 1/1999 | Ring et al. | 523/205 |
| 6,376,147 | B1 | 4/2002 | Bonsignore et al. | 430/114 |
| 6,508,876 | B1 | 1/2003 | Bernhardt et al. | 106/415 |
| 6,533,857 | B1 | 3/2003 | Schmid et al. | 106/403 |
| 6,699,313 | B2 | 3/2004 | Coulter et al. | 106/31.6 |
| 6,713,543 | B2 | 3/2004 | El-Shoubary et al. | 524/127 |
| 6,765,041 | B1 | 7/2004 | El-Shoubary et al. | 523/205 |
| 2003/0147830 | A1 | 8/2003 | Bertaux et al. | 424/63 |
| 2004/0228980 | A1 | 11/2004 | Wissing et al. | 427/508 |
| 2004/0265348 | A1 | 12/2004 | Hollenberg et al. | 424/401 |
| 2005/0100808 | A1 * | 5/2005 | Hashimoto et al. | 430/108.8 |
| 2005/0214666 | A1 * | 9/2005 | Schulze-Hagenest et al. | 430/108.2 |
| 2006/0164496 | A1 * | 7/2006 | Tokutake et al. | 347/112 |
| 2007/0032574 | A1 | 2/2007 | Kaupp | |

FOREIGN PATENT DOCUMENTS

| | | |
|---|---|---|
| DE | 12 34 234 | 2/1967 |
| DE | 197 08 167 | 9/1998 |
| DE | 198 20 112 | 11/1999 |
| DE | 198 26 399 | 12/1999 |
| DE | 199 29 523 | 1/2001 |
| DE | 696 25 650 | 11/2003 |
| EP | 0 268 918 | 6/1988 |
| EP | 0 285 977 | 10/1988 |
| EP | 0 492 223 | 7/1992 |
| EP | 0 675 176 | 10/1995 |
| EP | 0 707 051 | 4/1996 |
| EP | 0 721 005 | 7/1996 |
| EP | 1 258 782 | 11/2002 |
| JP | 58014142 | 1/1983 |
| JP | 62100770 | 5/1987 |
| JP | 62100771 | 5/1987 |
| JP | 62127753 | 6/1987 |
| JP | 62127754 | 6/1987 |
| JP | 01112254 | 10/1987 |
| JP | 63100468 | 5/1988 |
| JP | 10-298450 | 10/1998 |
| WO | 2004/092284 | 10/2004 |
| WO | WO 2005/076086 | 8/2005 |

OTHER PUBLICATIONS

International Search Report PCT/EP2005/012487 dated Feb. 7, 2006.

* cited by examiner

*Primary Examiner* — Hoa V Le
(74) *Attorney, Agent, or Firm* — Ostrolenk Faber LLP

(57) ABSTRACT

The invention relates to a dry toner, containing a platelet-type metal effect pigment or a plurality of platelet-type metal effect pigments and at least one resinous constituent, wherein the metal effect pigment or the metal effect pigments is/are additionally provided with a coating preferably suitable for improving the mechanical stability, and that this coating is additionally modified with at least one organic layer, which organic layer is selected from the group consisting of organofunctional silanes, organofunctional titanates, organofunctional zirconates, phosphonic acids, and phosphonates. The invention further relates to processes for the production of the dry toner and to the use thereof. Furthermore, the invention relates to a toner cartridge and to printed products.

37 Claims, No Drawings

DRY TONER, PROCESSES FOR THE PRODUCTION THEREOF, AND THE USE THEREOF

CROSS REFEREMCE TO RELATED APPLICATIONS

The application is a 35 U.S.C. §371 National Phase conversion of PCT/EP2005/012487 filed Nov. 22, 2005 which claims priority of German Patent Application 10 2004 056 330.6 filed Nov. 22, 2004 which are herein incorporated by reference. The PCT International Publication was publiched in the German Language.

BACKGROUND OF THE INVENTION

The present invention relates to a dry toner, to processes for the production of the dry toner, to the use of the dry toner, to a toner cartridge and to a printed product.

In recent years full color printers or color copiers, especially for the development of digital electrostatic images, have attracted much attention and are continuing to make advances.

The production of full color pictures by the principle of full color electrophotography is normally achieved by reproducing the colors with colored toners of the three primary colors yellow, magenta and cyan or with four-colored toners which additionally contain a black toner.

Electrophotography generally includes the production of a latent electrostatic image on a photoreceiver using a photoconductive substance, the development of the latent image with toner and, after the toner image has been transferred to paper etc., fixation of the toner image by the use of heat, pressure and solvent vaporization.

Color copying by employment of electrophotography is performed by multiple exposure of an original through a color filter and developing each electrostatic latent image with a suitable color toner, i.e. generally with yellow, magenta and cyan color toners in order to produce a color image consisting of a plurality of superimposed toner images.

In order to represent lustrous color impressions, it has hitherto been necessary to resort to toners having the aforementioned fundamental colors, yellow, cyan, magenta and black, but in such cases the problem has always been that the angle-dependent impressions of color, brightness and brilliance as well as the high luster of metallic surfaces could not, or only inadequately, be represented using such color combinations.

There has been no lack of attempts to produce color toners that could compensate for these deficiencies.

Patent applications JP 63100468 A, JP 62127754 A and JP 62127753 A disclose toner compositions with which metallic effects are reported to be simulated by using dark titanium oxide layers on platelet-type substrates with platelet-type purine derivatives or fish scales.

The patent applications JP 62100770 A and JP 62100771 A describe a silver or gold colored toner for electrophotography that is based on inorganic support materials coated with titanium oxide and/or iron oxide.

The toners described in the above-cited patent applications, however, to their detriment do not adequately approximate the properties of metal effect pigments in terms of color impression and covering power.

In U.S. Pat. No. 6,376,147 B1 a liquid toner composition is described in which metal effect pigments are used. The use of solvents in the toner composition is especially unfavorable from the standpoint of environmental friendliness and occupational safety. Another drawback is the fact that only a very limited number of printers are available for the use of liquid toner formulations. These printers must also be secured against the hazard of explosion because of the use of solvents in the toner compositions.

WO 2005/076086 A1 discloses a metallic color toner containing metal pigments having an organic coating. The organic coating used is an aliphatic acid, an acid amide, an acid salt, olefinic material, natural wax, synthetic wax, a polymer, or a combination of these. Optionally, an additional silicate, titanate, or aluminate layer may be applied to the metal pigment. A serious disadvantage is the fact that when stearic acid is used, i.e. an aliphatic acid, the toner material undergoes plasticization. Another disadvantage is that no prints with a lustrous and brilliant metallic appearance can be produced with this metallic toner.

In view of the above-listed disadvantages of toners, a need exists for a toner composition that is substantially dry, i.e. low in solvent, and, when used in electrophotographic printing processes, yields brilliant and angle-dependent reflecting prints of high color intensity.

SUMMARY OF THE INVENTION

The object of the invention is achieved by the preparation of a dry toner containing a platelet-type metal effect pigment or a plurality of platelet-type metal effect pigments and at least one resinous constituent, said metal effect pigment or pigments being provided additionally with a coating that preferably improves the mechanical stability, and said coating is additionally modified with at least one organic layer, said organic layer being selected from the group consisting of organofunctional silanes, organofunctional titanates, organofunctional zirconates, phosphonic acids, and phosphonates.

The toner of the invention is designated herein as a dry toner. The toner of the invention may have a certain residual moisture content but is not liquid and has a substantially particulate consistency.

The inventors have discovered, surprisingly, that it is possible to prepare a non-liquid toner using platelet-type metal pigments. This means, according to the present invention, that a pulverulent, low-solvent, preferably solvent-free, toner containing platelet-type metal pigments is prepared with which brilliant, metallic lustrous, full color or multi-color images can be produced.

Preferred developments of the dry toner are defined in the subordinate claims 2 to 14.

The dry toner preferably has a residual moisture content of no more than 10% by weight and preferably no more than 5% by weight, based on the total weight of the toner. According to another preferred embodiment, the residual moisture content is below 2% by weight and more preferably below 0.5% by weight. The dry toner most preferably contains no significant residual moisture, i.e. it is essentially free of solvents. According to another preferred development, the dry toner is free of solvents.

The present invention therefore provides a low-solvent, preferably solvent-free, dry toner producing a printed image which, because of the metal effect pigments, is brilliant, metallic lustrous, and of high optical quality.

Due to its low-solvent or solvent-free composition, the dry toner of the invention may be used in conventional printers and photocopiers without extra explosion-proofing.

It is preferred that the metal effect pigment(s) be selected from the group consisting of aluminum, copper, zinc, silver, gold, iron, titanium, brass, and bronze pigments and also alloy pigments and mixtures of these pigments.

For the purposes of the present invention, alloy pigments are pigments whose platelet-type metal core is an alloy of aluminum, copper, zinc, silver, gold, iron, titanium, brass, and/or gold bronze.

It is preferred that the metal effect pigment(s) have an average particle size of from 0.5 to 35 μm, preferably from 1 to 17 μm and more preferably from 2 to 10 μm.

The content of the metal effect pigment or pigments in the dry toner is preferably from 0.5 to 50% by weight, preferably from 5 to 25% by weight and more preferably from 10 to 15% by weight, in all cases based on the total weight of the dry toner.

According to the invention, the metal effect pigment or pigments is/are provided with a coating, preferably one that improves the mechanical and thermal stability.

This additional coating preferably surrounds the metal effect pigments. The coating may, for example, have an anti-corrosion effect so that even after an image has been printed, there is no corrosion and therefore no graying of the metal effect pigments. The coating also protects the pigments from oxidation due to the effects of temperature such as will occur during the printing/fixation process in the printer. Therefore, it is possible to create prints having long-lasting brilliance. The coating preferably imparts improved mechanical stability to the metal pigments so that the metal pigments are not damaged during the manufacture of the toner, its storage and transportation and/or the printing process, which might impair the quality of the printed image.

It is preferred that the coating of the metal effect pigment or pigments comprises or consists of one or more metal oxides. Such metal oxide(s) are preferably selected from the oxides of the elements of the group consisting of silicon, titanium, zirconium, aluminum, boron, cerium, chromium, and mixtures thereof.

A coating of, say, of silicon oxide, titanium oxide, zirconium oxide, aluminum oxide, boron oxide, cerium oxide, and/or chromium oxide has the advantage that both the mechanical and the thermal stability of the pigment as well as the electrical properties, especially the chargeability, of the pigments are improved.

According to the invention, the coating applied to the metal effect pigment or pigments is additionally modified with at least one organic layer.

The organic layer is applied by using one or more leafing-promoters selected from the group consisting of organofunctional silanes, organofunctional titatanates, organofunctional zirconates, phosphonic acids, phosphonates, and mixtures thereof. The aforementioned promoters each preferably contain aryl radicals and/or alkyl radicals which contain at least 3 carbons and may be fluorinated. The aryl radicals and/or alkyl radicals preferably contain from 3 to 24 carbons and more preferably from 6 to 18 carbons. The alkyl radicals may be branched or linear. The alkyl radicals are preferably linear.

Examples of such compounds are silanes such as propyltrimethoxysilane, propyltriethoxysilane, isobutyltrimethoxysilane, isobutyltriethoxysilane, hexadecyltrimethoxysilane, octadecyltrimethoxysilane, phenyltrimethoxysilane, phenyltriethoxysilane, tridecafluorooctyltriethoxysilane, tridecafluorooctyltrimethoxysilane, or other organofunctional silanes such as 3-methacryloxypropyltrimethoxysilane, polyether propyltrimethoxysilane as well as their partially hydrolyzed preparations, and also phosphonic acids such as octanephosphonic acid or octadecanephosphonic acid.

It has been found that this additional organic surface modification is advantageous in terms of the optical properties of the toner in the application. Metal effect pigments whose surface is modified with suitable modifiers tend to migrate during the printing process, i.e. during fixation, to the surface of the toner resin, which is molten at this time, and thereby produce extremely color-intense and brilliant prints. Among the above-named promoters, in particular, the leafing promoters containing alkyl radicals having at least 3 carbons to preferably 24 carbons, preferably from 6 to 18 carbons, have proven highly suitable. The term "leafing" here means that the metal effect pigments arrange themselves during the printing process on the surface or near the surface of the printed image. Since the metal effect pigments of the toner of the invention arrange themselves after the printing process on the surface of the printed image, i.e., the side of the applied film facing the viewer, the metallic effect, i.e. the lustrous and brilliant metallic properties, of the metal effect pigments are almost fully, preferably fully, manifested.

The aforementioned leafing promoters have the great advantage over aliphatic acids, especially fatty acids, in that they display a certain incompatibility with the toner resin, on the one hand, so that the metal effect pigments of the toner of the invention migrate during the fixation process to the boundary surface of the molten toner, while on the other hand they are bound firmly, preferably covalently, to the pigment surface. Advantageously, no plasticization of the toner resin, such as is described in WO 2005/076086, can occur.

Examples of particularly suitable metal pigments for the present application are the coated STANDART gold-bronze or copper powders L900, G900, E900, 7600, 8700 or Rotoflex, and also the coated bronze or copper pigments designated as "Dorolan" or "Resist" as well as the additionally surface-modified types based on these pigments. Suitable pigments based on aluminum are, for example, the pigment types PCR or Sillux (all available from Eckart GmbH & Co. KG, Fürth, Germany).

It is also preferred that the at least one resin constituent comprises or consists of at least one thermoplastic resin.

The thermoplastic resin is preferably selected from the group consisting of saturated or unsaturated polyesters, polyvinyl compounds, ethylene vinyl acetate, styrene copolymers, styrene acrylate, acrylates, methacrylates, polyethylene, polypropylene, polystyrene, styrene/butadiene, epoxides, polyamides, polycarbonates, polyurethanes, and mixtures thereof.

The content of the at least one resin constituent is preferably from 20 to 99.5% by weight, based on the total weight of the toner.

It is also preferred that the dry toner additionally contains one or more coloring agents preferably selected from the group consisting of coloring pigments, colored pigments, dyestuffs, and mixtures thereof.

In addition to the metal effect pigments, use may be made of other coloring agents, such as carbon black, mono/bis-azo pigments, magnetic powders, acridone pigments, triphenylmethane pigments, perylenes and/or azo pigments. Conventional colored pigments or dyestuffs may also be present, e.g., those having the fundamental colors cyan, magenta, yellow and/or black. Furthermore, red, blue, green, violet, white, orange pigments and/or dyes and/or fluorescence dyes may be present in the dry toner of the invention.

The content of additional coloring agents may be up to 20% by weight or more and more preferably ranges from about 1% by weight to 15% by weight, in each case based on the total weight of the dry toner.

As charge-controlling agents in the toner according to the invention, substances may be present that are suitable either for positively or negatively chargeable toners or for charge stabilization, e.g., triphenylmethane compounds, ammonium salts, Al-azo complexes, Cr-azo complexes, inorganic or organic polymer compounds either as pure substance or in modified form. Such substances are supplied, for example, by Clariant under the trade names "Copy" or "Hostacopy". The dry toner may also contain, as charge-controlling agents, for example silicic acid or metal salts in general.

The content of charge-controlling agents is ordinarily less than 5% by weight, preferably from about 1 to 3% by weight, in each case based on the total weight of the dry toner.

In general, the additives serve to influence or control, for example, the polarity, electrical properties, and/or the flowability.

In addition, the toner according to the invention may also contain carriers such as spherical or irregular ferrites. The carriers can cause triboelectric charging, i.e., static charging, which can improve the transport of the toner particles to the photoelectric layer.

The present invention therefore provides a dry and preferably low-solvent, more preferably solvent-free, toner for all type of electrophotography, said dry toner containing a platelet-type metal effect pigment or a plurality of platelet-type metal effect pigments as well as one or more resinous constituents. Metallic lustrous, brilliant and color intense images can be reproduced using the dry toners of the invention. At the same time, the toner is characterized by good properties in terms of the development of the latent electrostatic image due to good transfer of the developed image to a substrate and good fixation of the toner on the substrate.

The object of the invention is further achieved by a first process for the production of a dry toner, which comprises the following steps of (a) mixing of a metal pigment or a plurality of metal pigments additionally provided with a coating, preferably suitable for improving the mechanical stability, said coating being additionally modified with at least one organic layer, said organic layer being selected from the group consisting of organofunctional silanes, organofunctional titanates, organofunctional zirconates, phosphonic acids, and phosphonates, with toner resin and optionally additives such as coloring agents, charge-controlling agents and/or other additives, (b) extruding the mixture obtained in step (a), and (c) comminuting the extrudate obtained in step (b) to give a dry toner.

The extrusion in step (b) is preferably performed at a temperature of from 30° C. to 200° C. and more preferably from 50° C. to 100° C. In step (c), the comminution of the extrudate is preferably accomplished by grinding. The desired particles size of the dry toner can be adjusted by the grinding process used.

The toner of the invention can be produced, for example, by first mixing the toner resin, metal effect pigment, optionally color pigments or pigment compositions, optionally suitable charge-controlling agents or other additives at a temperature of from 15 to 150° C. and then extruding in, say, a twin-screw extruder, to give a homogeneous dispersion of all pigments and additives in the toner resin. The extrudate obtained can then be coarsely comminuted in a suitable mill, for example a hammer mill, followed by fine grinding in, say, a jet mill. The desired particle size is obtained by using a dry airstream classifier. Such a toner is characterized by relatively uneven and rough surfaces and by a relatively broad particle size distribution.

The object of the invention is further achieved by a second process for the production of a dry toner, which comprises the steps of (a) dispersing a metal pigment or a plurality of metal pigments additionally provided with a coating, preferably suitable for improving the mechanical stability, said coating being additionally modified with at least one organic layer, said organic layer being selected from the group consisting of organofunctional silanes, organofunctional titanates, organofunctional zirconates, phosphonic acids and phosphonates, in a liquid phase with the addition of a surfactant, b) adding an emulsion containing a polymerizable monomer or a plurality of polymerizable monomers to the dispersion obtained in step a), c) initiating polymerization of the polymerizable monomer or the polymerizable monomers, and d) isolating the polymer-encapsulated metal pigments.

The metal pigment or metal pigments is/are preferably dispersed in an aqueous or watery phase. Water can be used exclusively as the liquid phase, if desired. Preferably, surfactant is added to an extent such that the critical micelle-forming concentration (CMC) is exceeded.

Then an emulsion of one or more polymerizable hydrophobic monomers, preferably in water, is added to this surfactant-containing dispersion of the metal pigments.

The addition of the emulsion containing polymerizable hydrophobic monomer or monomers is preferably carried out with vigorous intermixing so that a homogeneous dispersion/emulsion is obtained. Then polymerization of the polymerizable monomer(s) is initiated in the preferably homogenized dispersion/emulsion. Initiation is preferably accomplished by adding a free-radical starter. Of course, polymerization can also be initiated by another method, for example by the introduction of energy. The polymerization causes the metal pigments to be surrounded by the resultant polymers. Preferably a complete polymer shell is formed, which may also be called a polymer capsule. The polymer-encapsulated metal pigments are then isolated, for example by screening, and classified if desired.

Preferably, the surfactants used are anionic surfactants, e.g. sodium dodecylsulfate, sodium dodecylbenzene sulfonate, polyoxyethylene alkyl ether sulfates or alkali salts of fatty acids, non-ionic surfactants such as alkylphenol ethoxylates, fatty alcohol ethoxylates, EO/PO-based block copolymers or cationic surfactants such as quaternized fatty amines.

Suitable monomers are preferably styrene or styrene derivatives, acrylic acid esters or methacrylic acid esters, (meth)acrylonitrile, vinyl ethers, dienes, and derivatives thereof.

With the second process so-called chemical toners containing metal effect pigments can be produced, which are characterized by smoother particle surfaces and a relatively narrow particle size distribution. Such chemical toners yield prints with improved resolution.

In the second production process, it is possible, if desired, to disperse toner resin, metal effect pigment, possibly additives, optionally other coloring agents or coloring agent compositions and suitable surfactants in a solvent, preferably water, if necessary at elevated temperature. Thereafter, the dispersion is subjected to high shearing stresses using, say, a Turrax blender. This causes very small polymer drops to be formed around the platelet-type pigment particles, which contain the other additives and coloring agents. The platelet-type pigment particles are therefore, to a great extent, surrounded or encapsulated by a polymeric or resinous material. After cooling to room temperature, the polymer-encapsulated metal effect pigments are isolated and used directly as dry toner. In the second process, advantageously, toner particles with a spherical particle structure and uniform particle size are produced. The dry toner produced by the second process is particularly suitable for applications where high resolution is important.

While coarser metal effect pigments are used in the first process that must be further comminuted in the subsequent grinding process, the particle size of the toner particles produced in the second process is determined by the size of the metal effect pigments. In the second process, preference is given to the use of pigments having a diameter less than, or equal to, 10 μm.

It is generally preferred that the particle size of the dry toner be in a range of from 0.5 to 15 μm, more preferably from 2 to 10 μm and even more preferably from 4 to 6 μm. The more fine-grained the dry toner is, the better the resolution in the printed image. If high resolution in the print is not required, the toner particles may have an even larger particle diameter, such as 20 μm, 25 μm, or larger.

Preferred developments of the process of the invention are defined in the subordinate claims 17 to 29. The statements made regarding the dry toner of the invention are applicable accordingly.

The object of the invention is further achieved by the use of the dry toner of the invention in laser printers, LED printers, copiers, and digital printers.

The object of the invention is also achieved by a toner cartridge containing the dry toner of the invention.

Finally the object of the invention is also achieved by a printed product whenever printed or imprinted using the toner of the invention. The printed product may, for example, be an imprinted sheet material such as paper, film, or textile material. The printed product may, however, be a three-dimensional object such as a package, a bottle, a can, or a housing.

The invention is further clarified by the following non-restrictive examples.

EXAMPLE 1

Toner powder for production of prints showing a gold-metallic luster by melt extrusion (in percentages by weight)

12% Dorolan 08 Reichgold STANDART gold-bronze powder (supplied by Eckart)

1% Copy Charge N4P (charge-controlling agent supplied by Clariant )

12% Hostacopy HG-Y 101 (yellow pigment preparation supplied by Clariant)

75% Fine-Tone 382 (polyester resin supplied by Reichhold).

The materials are pre-mixed in a mixer and subsequently extruded with a twin-screw extruder at approx. 120° C. The cooled extrudate is comminuted in a hammer mill into pieces of a few millimeters in size and then finely pulverized in an air jet pulverizer.

A gold lustrous metallic effect is observed after application.

EXAMPLE 2

Toner powder for production of prints with a gold-metallic luster by emulsion polymerization To produce the pigment dispersion 3.6 g of sodium dodecylsulfate are dissolved in 200 ml of fully demineralized (FD) water, and 10 g of Dorolan 08 Bleichgold are dispersed in this solution with stirring.

In a separate one-liter flask equipped with an agitator, heat sensor, and reflux condenser there are placed, under a blanket of nitrogen, 250 ml of degassed FD water, 1.2 g of sodium dodecyl sulfate, 25 g of styrene, 75 g of n-butyl acrylate, 1.5 g of methacrylic acid, and 0.2 g of dodecyl mercaptan and the mixture is finely emulsified by means of an Ultra-Turrax. After addition of the pigment dispersion, the mixture is heated to 70° C., and stirring is continued while a solution of 1.0 g of potassium persulfate in 50 ml of degassed FD water is added.

The resulting mixture is polymerized for 5 h, and then cooled down to room temperature. The now polymer-encapsulated pigment particles are removed and dried in vacuo.

The invention claimed is:

1. A dry toner, comprising at least one platelet-type metal effect pigment and at least one resin constituent, wherein said pigment is provided with a metal oxide coating, suitable for improving its mechanical stability, and wherein the metal oxide coating is covalently bonded with an organic layer that is disposed on the metal oxide coating, the organic layer including at least one organic leafing promoter that is selected from the group consisting of organofunctional silanes, organofunctional titanates, organofunctional zirconates, phosphonic acids, and phosphonates, wherein when said resin constituent is molten said organic leafing promoter causes the migration of said metal effect pigment to the surface of said molten resin constituent.

2. The dry toner as defined in claim 1, said toner having a residual moisture content of not more than 10% by weight, based on the total weight of the dry toner.

3. The dry toner as defined in claim 1, wherein the at least one metal effect pigment is selected from the group consisting of aluminum, copper, zinc, silver, gold, iron, titanium, brass, and bronze pigments, alloy pigments and mixtures of these pigments.

4. The dry toner as defined in claim 1, wherein the at least one metal effect pigment has a mean particle size of from 0.5 μm to 35 μm.

5. The dry toner as defined in claim 1, wherein the content of the at least one metal effect pigment in the dry toner is from 0.5 to 50% by weight, based on the total weight of the dry toner.

6. The dry toner as defined in claim 1, wherein the at least one metal oxide is selected from oxides of elements selected from the group consisting of silicon, titanium, zirconium, aluminum, boron, cerium, chromium, and mixtures thereof.

7. The dry toner as defined in claim 1, wherein the at least one resin constituent comprises at least one thermoplastic resin.

8. The dry toner as defined in claim 7, wherein the thermoplastic resin is selected from the group consisting of saturated and unsaturated polyesters, polyvinyl compounds, ethylene vinylacetate, styrene copolymers, styrene acrylate, acrylates, methacrylates, polyethylene, polypropylene, polystyrene, styrene butadiene, epoxides, polyamides, polycarbonates, polyurethanes, and mixtures thereof.

9. The dry toner as defined in claim 1, wherein the content of the at least one resin constituent is from 20 to 99.5% by weight, based on the total weight of the toner.

10. The dry toner as defined in claim 1, wherein the dry toner additionally contains at least one coloring agent.

11. The dry toner as defined in claim 10, wherein the at least one coloring agent is selected from the group consisting of coloring pigments, colored pigments, dyes, and mixtures thereof.

12. The dry toner as defined in claim 1, wherein the dry toner additionally contains at least one charge-controlling agent.

13. A process for the production of a dry toner as defined in claim 1, comprising the steps of (a) mixing with a toner resin at least one metal pigment provided with a coating suitable for improving the mechanical stability of said pigment, wherein said coating is modified with said organic leafing promoter, (b) extruding the mixture obtained in step (a), and (c) comminuting the extrudate obtained in step (b) to give a dry toner.

14. A process for the production of a dry toner as defined in claim 1, comprising the steps of (a) dispersing in a liquid phase with the addition of a surfactant at least one metal pigment provided with a coating suitable for improving the mechanical stability of said pigment, wherein said coating is modified with said organic leafing promoter, (b) adding an emulsion containing at least one polymerizable monomer to the dispersion obtained in step a), c)initiating polymerization of the at least one polymerizable monomer and d)isolating the polymer-encapsulated metal pigments thus produced.

15. The process as defined in claim 13, wherein the dry toner has a residual moisture content of not more than 10% by weight based on the total weight of the dry toner.

16. The process as defined in claim 13, wherein the at least one metal effect pigment is selected from the group consisting of aluminum, copper, zinc, silver, gold, iron, titanium, brass, and bronze pigments, alloy pigments and mixtures of these pigments.

17. The process as defined in claim 13, wherein the at least one metal effect pigment has a mean particle size of from 0.5 μm to 35 μm.

18. The process as defined in claim 13, wherein the content of the at least one metal effect pigment is from 0.5 to 50% by weight based on the total weight of the dry toner.

19. The process as defined in claim 13, wherein the coating of the at least one metal effect pigment comprises one or more metal oxides.

20. The process as defined in claim 19, wherein the at least one metal oxide is selected from oxides of elements selected from the group consisting of silicon, titanium, zirconium, aluminum, boron, cerium, chromium, and mixtures thereof.

21. The process as defined in claim 13, wherein said toner resin comprises at least one thermoplastic resin.

22. The process as defined in claim 21 wherein the thermoplastic resin is selected from the group consisting of saturated and unsaturated polyesters, polyvinyl compounds, ethylene vinylacetate, styrene copolymers, styrene acrylate, acrylates, methacrylates, polyethylene, polypropylene, polystyrene, styrene butadiene, epoxides, polyamides, polycarbonates, polyurethanes, and mixtures thereof.

23. The process as defined in claim 13, wherein the content of said toner resin is from 20% to 99.5% by weight, based on the total weight of the toner.

24. (Previously Presented The process as defined in claim 13, wherein the dry toner additionally contains at least one coloring agent.

25. The process as defined in claim 24, wherein the at least one coloring agent is selected from the group consisting of coloring pigments, colored pigments, dyes, and mixtures thereof.

26. The process as defined in claim 13, wherein the dry toner additionally contains one or more charge-controlling agents.

27. A toner cartridge, wherein the toner cartridge contains a dry toner as defined in claim 1.

28. A printed product, wherein the printed product has been produced using a dry toner as defined in claim 1.

29. The dry toner as defined in claim 2, wherein the at least one metal effect pigment is selected from the group consisting of aluminum, copper, zinc, silver, gold, iron, titanium, brass, and bronze pigments, alloy pigments and mixtures of these pigments.

30. The process as defined in claim 14, wherein the dry toner has a residual moisture content of not more than 10% by weight based on the total weight of the dry toner.

31. The dry toner as defined in claim 1, said toner having a residual moisture content of not more than 5% by weight, based on the total weight of the dry toner.

32. The dry toner as defined in claim 1, wherein the at least one metal effect pigment has a mean particle size of from 1 μm to 17 μm.

33. The dry toner as defined in claim 1, wherein the content of the at least one metal effect pigment in the dry toner is from 5 to 25% by weight, based on the total weight of the dry toner.

34. The dry toner as defined in claim 1, wherein said organic leafing promoter comprises one of at least one aryl radical and at least one alkyl radical, each said radical comprising from 3 to 24 carbons.

35. A laser printer comprising the toner cartridge according to claim 27.

36. A copier comprising the toner cartridge according to claim 27.

37. A digital printing machine comprising the toner cartridge according to claim 27.

* * * * *